US006912822B2

(12) United States Patent
Vos

(10) Patent No.: US 6,912,822 B2
(45) Date of Patent: Jul. 5, 2005

(54) PROFILED SHEETS

(76) Inventor: Carlo Vos, 292 Long Avenue, Ferndale, Randburg (ZA), 2194

( * ) Notice: Subject to any disclaimer, the term of this patent is extended or adjusted under 35 U.S.C. 154(b) by 0 days.

(21) Appl. No.: 10/313,437

(22) Filed: Dec. 5, 2002

(65) Prior Publication Data

US 2003/0110730 A1 Jun. 19, 2003

(30) Foreign Application Priority Data

Dec. 10, 2001 (ZA) ..... 2001/10126

(51) Int. Cl.[7] ..... E04C 2/32
(52) U.S. Cl. ..... 52/522; 52/537
(58) Field of Search ..... 52/542, 535, 537, 52/580, 588.1, 599, 522, 523, 789.1, 783.1, 783.14, 783.18, 536, 406.1; 248/903

(56) References Cited

U.S. PATENT DOCUMENTS 3,969,866 A * 7/1976 Kyne ..... 52/588.1
4,005,942 A * 2/1977 Gilb ..... 403/189
5,524,409 A * 6/1996 Kaiser ..... 52/588.1
6,223,488 B1 * 5/2001 Pelfrey et al. ..... 52/302.1
6,415,581 B1 * 7/2002 Shipman et al. ..... 52/798.1
2003/0154682 A1 * 8/2003 Liviero et al. ..... 52/578

FOREIGN PATENT DOCUMENTS

ZA 93/9513 8/1998

* cited by examiner

*Primary Examiner*—Ramon O Ramirez
(74) *Attorney, Agent, or Firm*—Merchant & Gould P.C.

(57) ABSTRACT

The disclosure relates to a profiled sheet comprising a web formation having first and second opposite ends; a first panel segment extending generally transversely from the web formation at or towards the first end thereof and a second panel segment, extending generally transversely from the web formation at or towards the second end thereof. The first and second panel segments extend in opposite directions from the web formation and the sheet further comprises a lip formation extending generally transversely from the first panel segment at an end defined by the said panel segment distal to the web formation and extending in a direction towards the plane wherein the second panel segment is located.

8 Claims, 7 Drawing Sheets

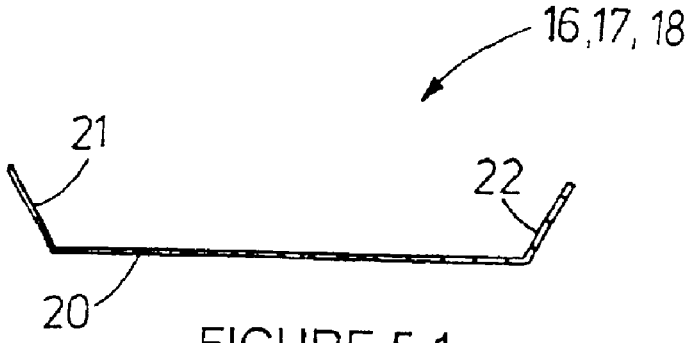
FIGURE 5.1
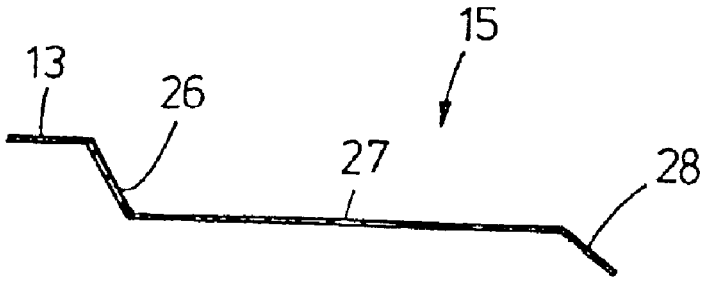
FIGURE 5.2
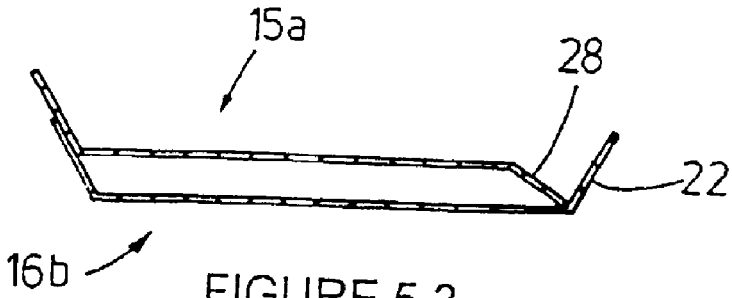
FIGURE 5.3
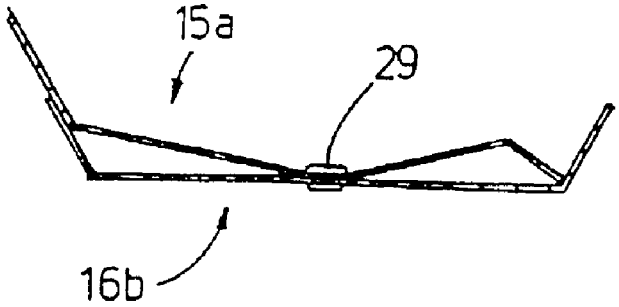
FIGURE 5.4

PROFILED SHEETS

FIELD OF THE INVENTION

This invention relates to profiled sheets.

BACKGROUND TO THE INVENTION

Profiled sheets have been described in South African patent number 93/9513. The South African Patent discloses, as illustrated in FIG. 6 of the present application, a profiled sheet (1) comprising two panel segments (2 and 3) which are laterally offset from each other, said panel segments being connected by virtue of a web formation (4) there-between. Furthermore there are included longitudinal groove formations (5 and 6) at the free end of each panel segment as well as longitudinal tongue formations (7 and 8) at the web formation (4).

The South African Patent discloses, as illustrated in FIG. 7 of the present application, when profiled sheets (1*a*, 1*b* and 1*c*) are assembled, the tongue formation (7) of sheet (1*a*) is snugly received in the groove formation (5) of sheet (1*b*), while the tongue formation (7) of sheet (1*b*) is similarly received in the groove formation (5) of sheet (1*c*).

At the upper surface of the structure the groove formation (6) of sheet (1*a*) snugly receives the tongue formation (8) of sheet (1*b*) and the groove formation (6) of sheet (1*b*) similarly receives the tongue formation (8) of sheet (1*c*).

In order to secure the sheets together, and over and above the fact that the tongue formations and groove formations inter connect in a snap fit fashion, it is necessary in practice to secure the sheets by placing rivets or roof bolts through the interconnected tongue and groove formations.

It will be appreciated that in order to carry this out it is necessary to rivet the tongue and groove formations on both sides of the assembled structure. This may often prove to be impractical and time consuming. A further disadvantage is that due to the rounded tongue and groove formations it is difficult to place close fitting borders around the sheets since the rounded formations in use cause the borders to be spaced from the panel segments.

OBJECT OF THE INVENTION

It is an object of the invention to overcome or at least reduce some of the disadvantages as set out above.

SUMMARY OF THE INVENTION

According to the present invention there is provided a profiled sheet comprising a web formation having first and second opposite ends; a first panel segment extending generally transversely from the web formation at or towards the first end thereof; a second panel segment, extending generally transversely from the web formation at or towards the second end thereof; the first and second panel segments extending in opposite directions from the web formation; and the sheet further comprising a lip formation extending generally transversely from the first panel segment at an end defined by the said panel segment distal to the web formation and extending in a direction towards the plane wherein the second panel segment is located.

The web formation may extend substantially normal between the panel segments.

In one embodiment of the invention the profiled sheet preferably includes at least one engagement formation on at least one panel segment which engagement formation is suitable, in use, to engage a similar engagement formation on a similar profiled sheet. The at least one engagement formation preferably extends across the at least one panel segment in a direction generally parallel to the web formation.

In a preferred embodiment of the invention engagement formations are located at or towards the end of the second panel segment distal to the web formation as well as at or towards the end of the second panel segment proximate to the web formation.

In a preferred arrangement, the engagement formation located at or towards the end of the second panel segment distal to the web formation is adapted to engage the engagement formation located at or towards the end of the second panel segment proximate to the web formation of a similar sheet contiguously placed with the first sheet.

In another preferred embodiment of the invention engagement formations are provided in the lip formation and the web formation such that in use, the engagement formation in the web formation is suitable to engage a corresponding engagement formation provided in the lip formation of a similar profiled sheet.

The engagement formations may have various forms. In one embodiment of the invention an engagement formation may comprise a groove formation. In a preferred embodiment of the invention a groove formation may comprise a base and two opposing side walls which extend from the base.

Preferably the end of the second panel segment distal to the web formation defines an engagement segment which extends at a slanted angle to the panel segment. Preferably it slants away from the web formation and preferably the web formation and engagement segment are located on the same side of the second panel segment.

Preferably, the engagement formation located at or towards the end of the second panel segment distal to the web formation comprises a first section extending generally transversely from the second panel segment, a second section extending generally transversely from the first section away from the web formation and a third section extending generally transversely from the second section, the first and third sections being in a non-opposing relationship. The third section may in use define the engagement segment described above. Preferably the first section is in an opposing relationship to the web formation.

The profiled sheet may also include at least one reinforcement formation. Preferably a reinforcement formation is provided at or towards the middle of the first and second panel segments.

The profiled sheet according to the present invention may be made of any suitable resilient material such as polymeric materials or metallic materials. In a most preferred form of the invention the sheet may be made of mild steel, stainless steel or aluminium. The sheet may also be pre-coated with a decorative or protective coating.

The invention also relates to structures formed by securing a number of profiled sheets to each other, such structures being for example roofs and walls.

BRIEF DESCRIPTION OF THE DRAWINGS

Without thereby limiting the scope of the invention and by means of example only an embodiment of the invention will now be described with reference to the accompanying drawings in which:

FIGS. 5.1 to 5.4. are enlarged side views of the engagement formations of the profiled sheet of FIG. 1;

Figure 6:
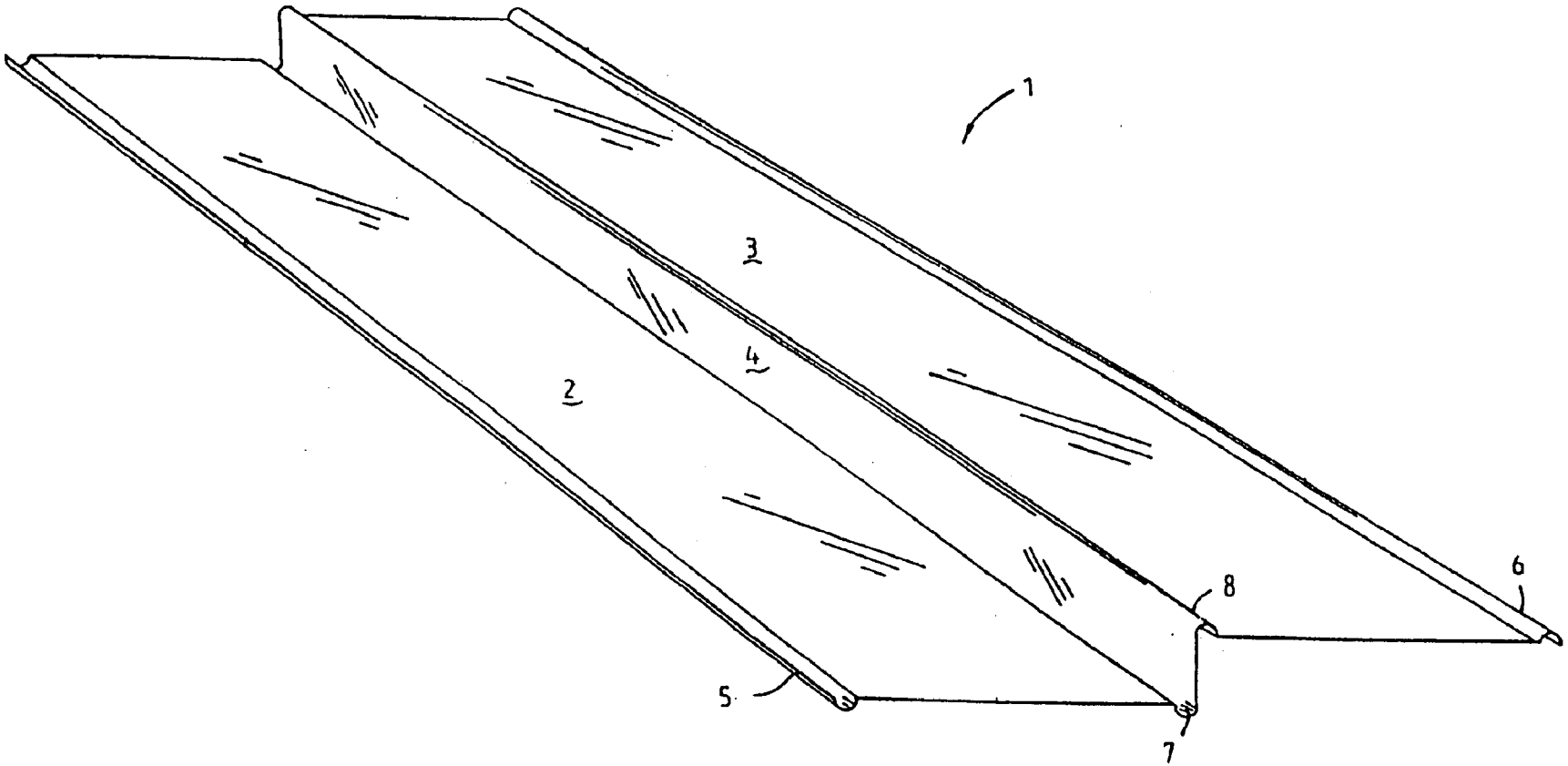
FIGURE 6 (PRIOR ART)
Figure 7:
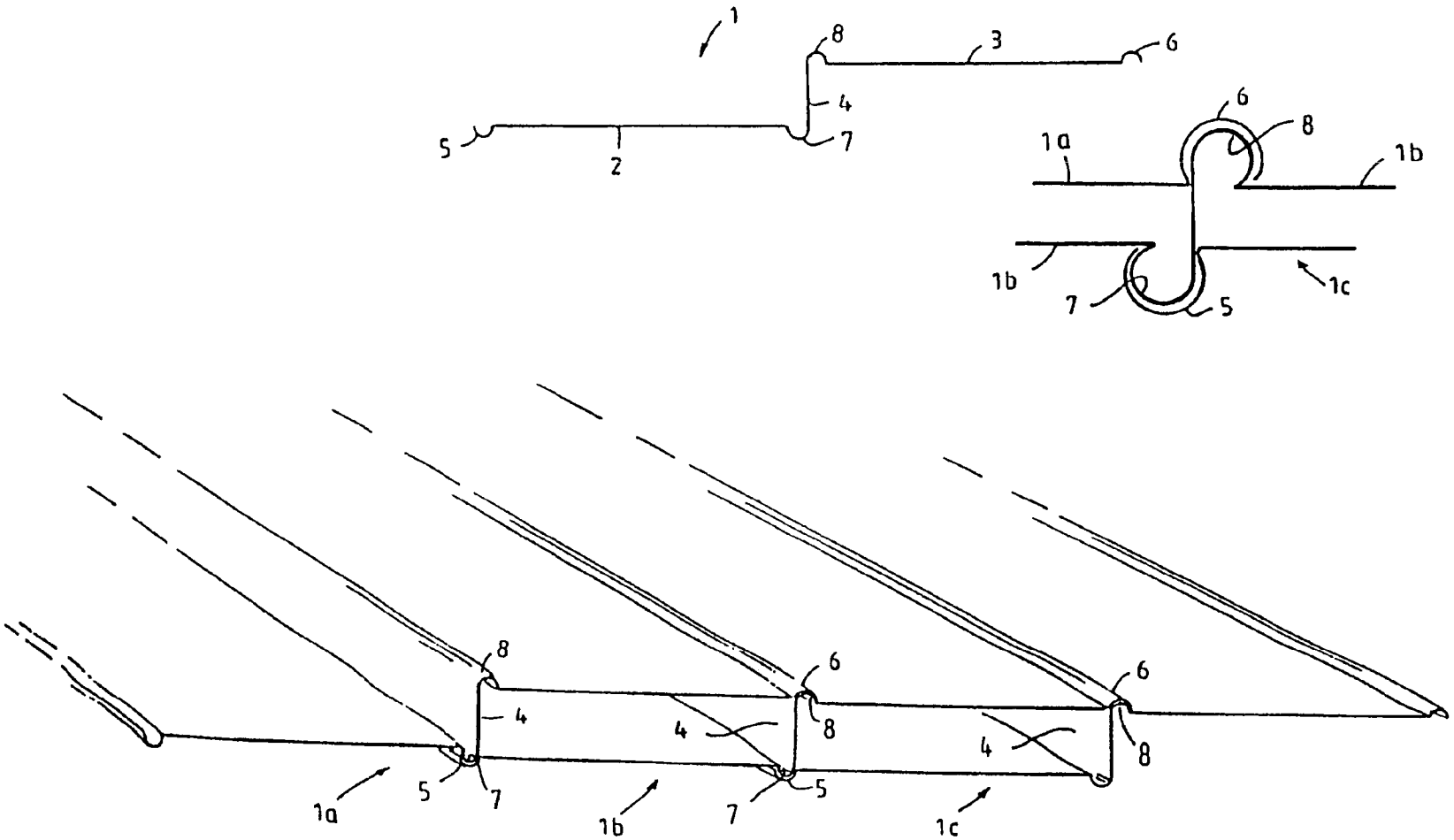
FIGURE 7 (PRIOR ART)

The description of the profiled sheets according to the invention in South African patent number 93/9513 is described in the above background to the invention with reference to the following figures:

FIG. 6 is a perspective view of the prior art profiled sheets according to South African patent number 93/9513;

FIG. 7 is a side and a perspective view of a number of profiled sheets in use according to South African patent number 93/9513.

DETAILED DESCRIPTION OF THE INVENTION

Figure 1:
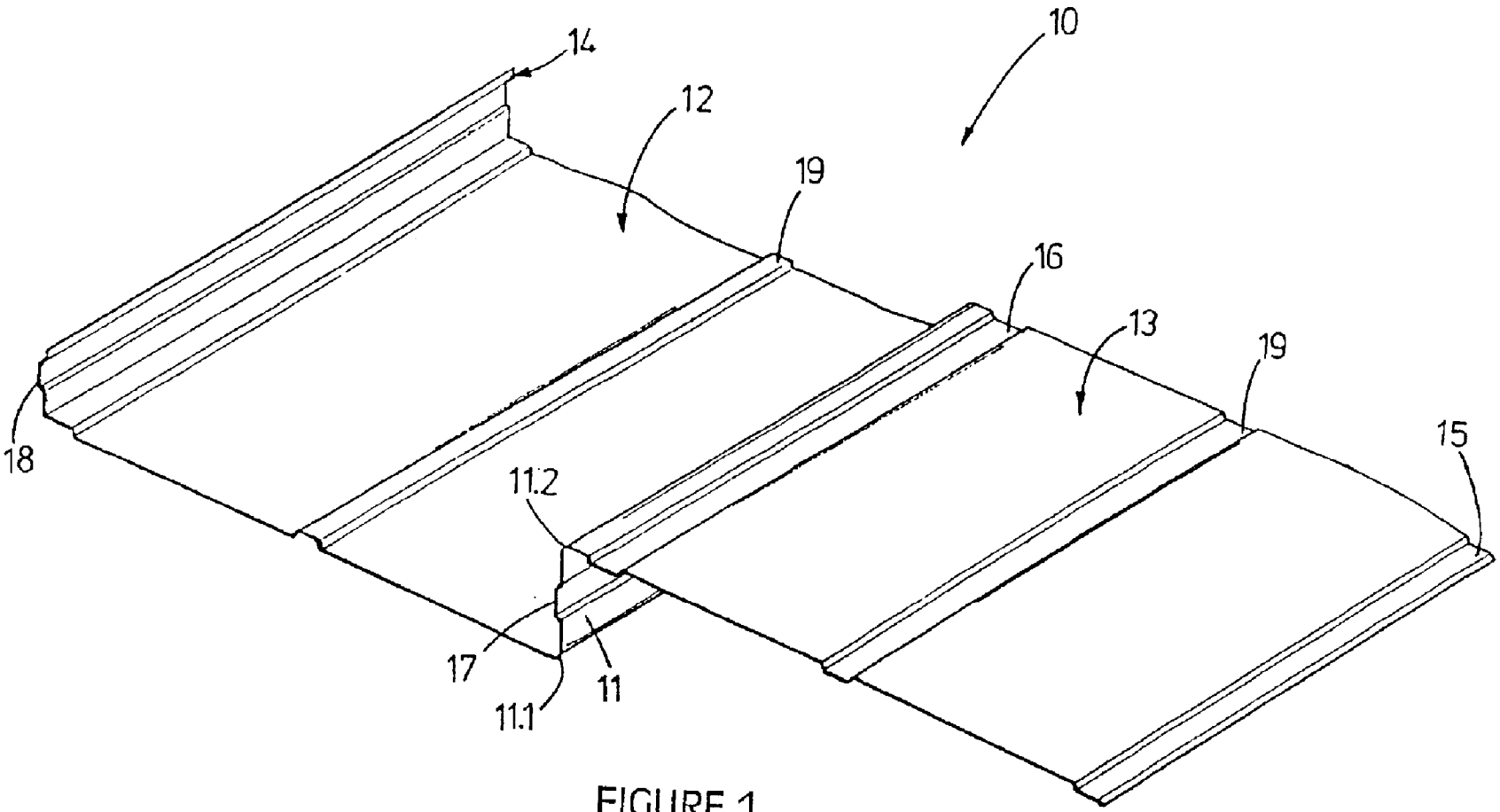
FIG. 1: is a perspective view of the profiled sheet according to the invention.

Referring to FIG. 1, the profiled sheet (10) comprises a web formation (11) having a first end (11.1) and a second end (11.2) opposite to each other. A first panel segment (12) extends transversely from the first end (11.1) of the web formation (11). A second panel segment (13) extends transversely from the second end (11.2) of the web formation (11) in an opposite direction to the first panel segment (12). The profiled sheet (10) is made of mild stainless steel.

The first panel segment (12) includes a lip formation (14) at an end distal to the web formation (11), the lip formation (14) extending normal to the first panel segment (12) in a direction towards the plane wherein the second panel segment (13) lies.

Engagement formations are provided in the profiled sheet (10) and more particularly there is provided an engagement formation (15) at the end of the second panel segment (13) distal to the web formation (11) as well as an engagement formation (16) on the second panel segment (13) proximate to the web formation (11).

A further engagement formation (17) is provided in the web formation (11). Still further, an engagement formation (18) is provided in the lip formation (14). The engagement formation (17) of one sheet (10) is suitable to engage the engagement formation (18) of another sheet (10).

In order to reinforce the panel segments (12 and 13), reinforcement formations (19) are provided in the middle of the panel segments (12 and 13).

Figure 2:
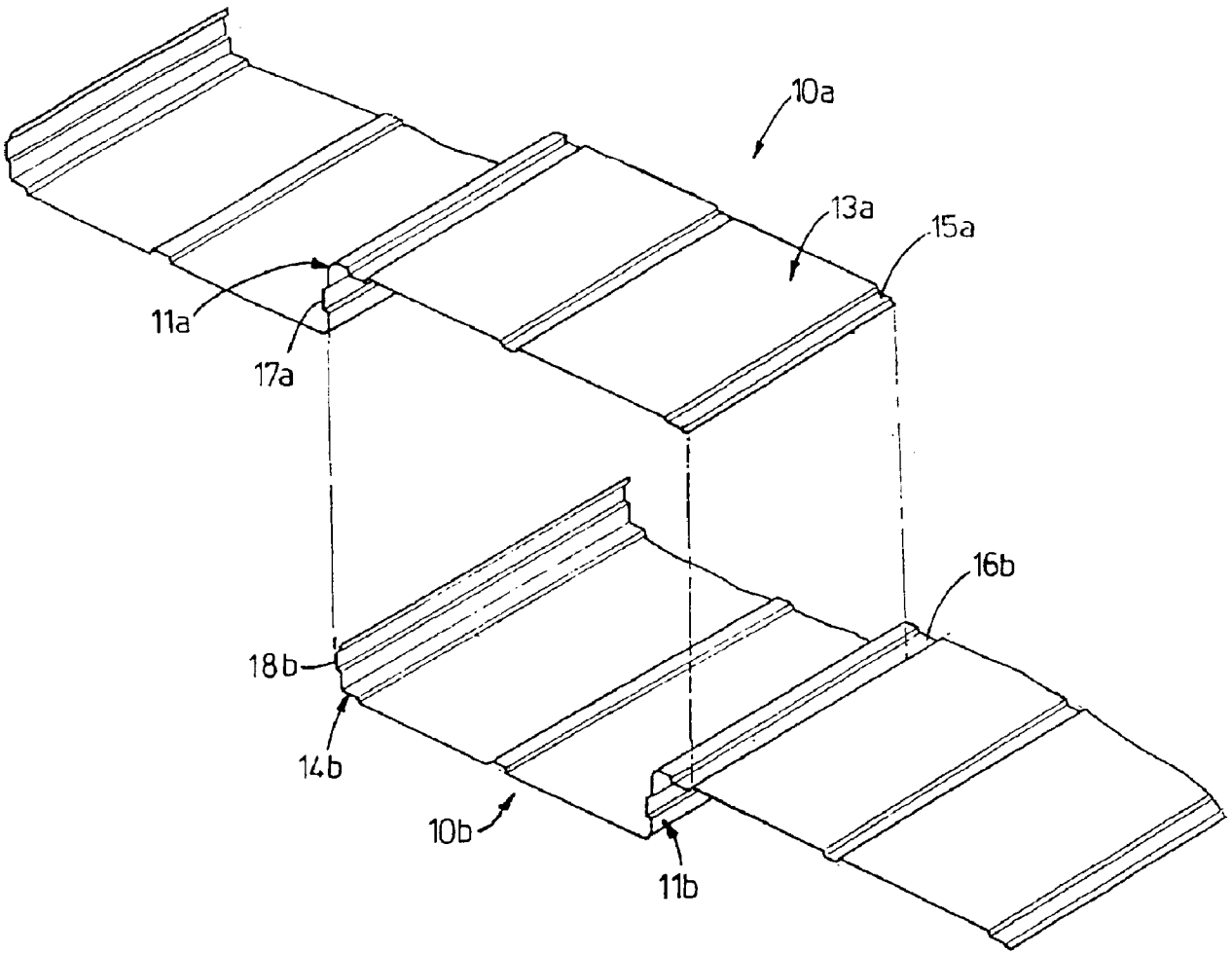
FIG. 2: is an exploded perspective view of two profiled sheets of FIG. 1 in a partly assembled configuration.
Figure 3:
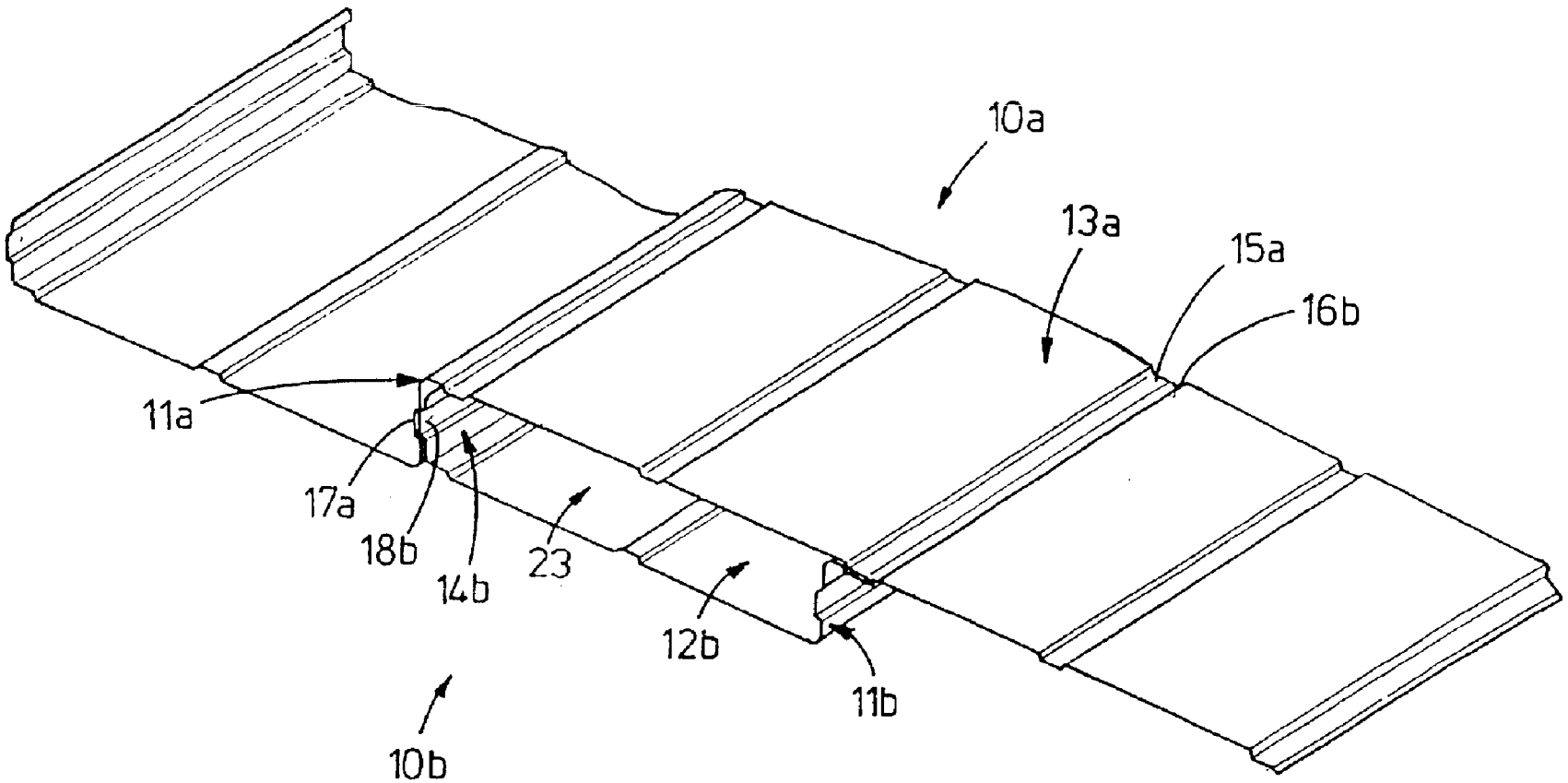
FIG. 3: is a perspective view of the profiled sheets of FIG. 2 in a fully assembled configuration.

Referring to FIGS. 2 and 3 of the invention, there is provided two profiled sheets (10*a* and 10*b*), the first profiled sheet (10*a*) being placed contiguously with the second profiled sheet (10*b*) such that the engagement formation (15*a*) at the end of the second panel segment (13*a*) of the first profiled sheet (10*a*) is received by the engagement formation (16*b*) of the second profiled sheet (10*b*).

Furthermore, upon placing the first profiled sheet (10*a*) contiguous to the second profiled sheet (10*b*), the engagement formation (18*b*) in the lip formation (14*b*) of the second profiled sheet (10*b*) is received by the engagement formation (17*a*) in the web formation (1l*a*) of the first profiled sheet (10*a*).

It will be appreciated that over and above the engagement formations which aid in securing the profiled sheets according to the present invention, it may be necessary to secure one profiled sheet to another. In use, and referring to FIGS. 3 and 4, roof bolts or rivets (not shown) are used to secure engagement formation (15*a*) of the first profiled sheet (10*a*) to engagement formation (16*b*) of the second profiled sheet (10*b*). Furthermore rivets and the like (not shown) are used to secure engagement formation (17*a*) of the first profiled sheet (10*a*) to engagement formation (18*b*) of the second profiled sheet (10*b*).

Accordingly, in using the profiled sheets for the purposes of constructing for example, a roof, it will be unnecessary for one to work from below the roof in order to secure the profiled sheets together as is necessary in South African patent number 93/9513.

Once the profiled sheets have been secured together, it will be appreciated that a space (23 in FIG. 3) is formed between the second panel segment (13*a*) of the first profiled sheet (10*a*) and the first panel segment (12*b*) of the second profiled sheet (10*b*). The space (23 in FIG. 3) so formed can then be filled with a suitable filler such as polystyrene (24 in FIG. 4) thus providing insulation and added strength to the roof or other structure (e.g. a wall).

Figure 4:
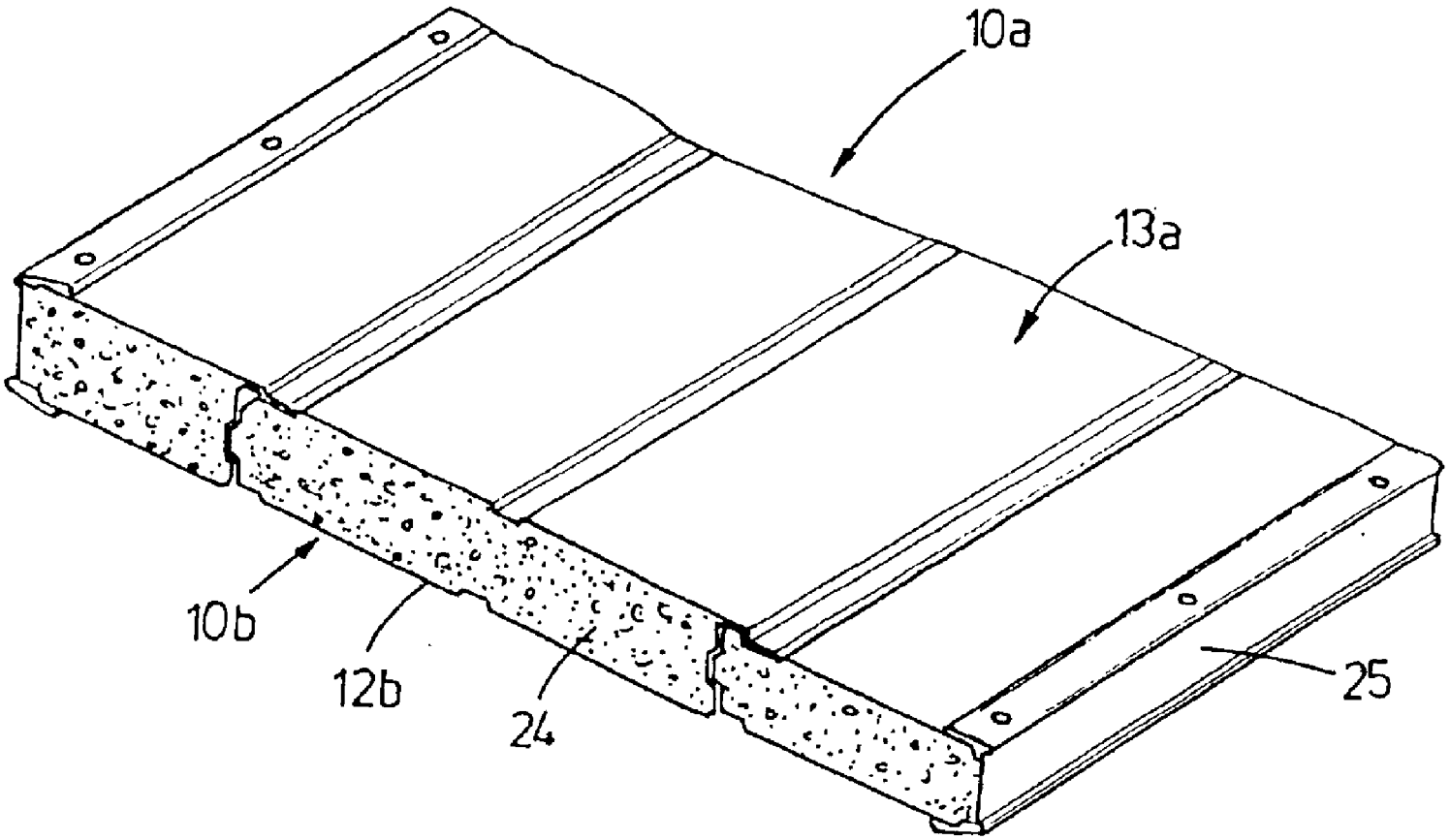
FIG. 4: is a perspective view of the profiled sheets of FIG. 3 with a filler.

There are also provided channel shaped borders (25) as shown in FIG. 4 which are placed at the ends of the roof or other structure so as to close off at least one end of the space (23 in FIG. 3).

Referring to FIG. 5.1, engagement formations (16, 17 and 18) comprise groove formations each defining a base (20) and two opposing side walls (21 and 22) extending from base (20).

Referring to FIG. 5.2. the engagement formation (15) located at the end of the second panel segment (13) distal to the web formation (not shown) comprises a first section (26) extending generally transversely from the second panel segment (13) which is akin to a side wall, a second section (27) extending generally transversely from the first section (26), which is akin to a base, and a third section (28) which extends generally transversely from the second section (27), the third section (28) being akin to a side wall and being in a non opposing relationship to the first section (26). The third section (28) defines an engagement segment which extends at a slanted angle to the panel segment (13).

It will be appreciated that the engagement formation (15) has a generally "Z"-shaped configuration.

Referring to FIG. 5.3. and in the situation in which a first profiled sheet is placed contiguously over a second profiled sheet, engagement formation (15*a*), of the first profiled sheet is received by engagement formation (16*b*) of the second profiled sheet such that the engagement segment (28) of engagement formation (15*a*) engages side wall (22) of engagement formation (16*b*).

Referring to FIG. 5.4, when engagement formation (15*a*) is secured to engagement formation (16*b*) by a rivet or bolt (29) a seal is thus formed between the two sheets.

The above is only one embodiment of the invention and it will be appreciated that many variations in detail are possible without thereby departing from the scope and spirit of the invention.

What is claimed is:

1. A profiled sheet comprising a web formation having first and second opposite ends; a first panel segment extending generally transversely from the web formation at or towards the first end thereof; a second panel segment, extending generally transversely from the web formation at or towards the second end thereof; the first and second panel segments extending in opposite directions from the web formation; and the sheet further comprising a lip formation extending generally transversely from the first panel segment at an end defined by the panel segment distal to the web formation and extending from the first panel segment in a direction towards a plane wherein the second panel segment is located;

wherein an engagement formation is located at or towards the end of the second panel segment distal to the web formation and an engagement formation in the form of a groove formation is located at or towards the end of the second panel segment proximate to the web formation; with the engagement formation located at or towards the end of the second panel segment distal to the web formation being suitable to engage the engagement formation located at or towards the end of the second panel segment proximate to the web formation of a similar profiled sheet; and each said engagement formation extending across the second panel segment in a direction generally parallel to the web formation; and wherein the lip formation includes an engagement formation in the form of a groove formation and wherein the web formation includes an engagement formation in the form of a groove formation suitable to engage an engagement formation in the form of a groove formation provided in the lip formation on a similar profiled sheet.

2. The profiled sheet according to claim 1, wherein the web formation extends normal between the panel segments.

3. The profiled sheet according to claim 1, wherein the end of the second panel segment distal to the web formation defines an engagement segment which extends at a slanted angle to the panel segment.

4. The profiled sheet according to claim 3, wherein the engagement segment slants away from the web formation and wherein the web formation and engagement segment are located on the same side of the second panel segment.

5. The profiled sheet according to claim 1, wherein the engagement formation located at or towards the end of the second panel segment distal to the web formation comprises a first section extending generally transversely from the second panel segment, a second section extending generally transversely from the first section away from the web formation and a third section extending generally transversely from the second section, the first and third sections being in a non-opposing relationship and the third section extending at a slanted angle to the panel section to define an engagement section.

6. The profiled sheet according to claim 1, which includes at least one reinforcement formation.

7. The profiled sheet according to claim 6, which includes two reinforcement formations wherein the reinforcement formations are located at or towards the middle of the first and second panel segments.

8. A profiled sheet comprising a web formation having first and second opposite ends; a first panel segment extending generally transversely from the web formation at or towards the first end thereof; a second panel segment, extending generally transversely from the web formation at or towards the second end thereof; the first and second panel segments extending in opposite directions from the web formation; and the sheet further comprising a lip formation extending generally transversely from the first panel segment at an end defined by the said panel segment distal to the web formation and extending in a direction towards a plane wherein the second panel segment is located, wherein at least one of the panel segments includes at least one engagement formation suitable to engage at least one similar engagement formation on a similar profiled sheet, the at least one engagement formation extending across the at least one panel segment in a direction generally parallel to the web formation, wherein the second panel segment includes an engagement formation located at or towards the end of the second panel segment distal to the web formation and includes an engagement formation at or towards the end of the second panel segment proximate to the web formation, and wherein the engagement formation located at or towards the end of the second panel segment distal to the web formation comprises a first section extending generally transversely from the second panel segment, a second section extending generally transversely from the first section away from the web formation and a third section extending generally transversely from the second section, the first and third sections being in a non-opposing relationship and the third section extending at a slanted angle to the panel section to define an engagement section.

* * * * *